United States Patent [19]

Siwiak et al.

[11] Patent Number: 4,737,797

[45] Date of Patent: Apr. 12, 1988

[54] MICROSTRIP BALUN-ANTENNA APPARATUS

[75] Inventors: Kazimierz Siwiak, Coral Springs; Albert A. Kong, Plantation, both of Fla.

[73] Assignee: Motorola, Inc., Schaumburg, Ill.

[21] Appl. No.: 878,898

[22] Filed: Jun. 26, 1986

[51] Int. Cl.[4] ..... H01Q 1/38; H01Q 9/16; H01P 5/10

[52] U.S. Cl. ..... 343/859; 343/821; 333/26

[58] Field of Search ..... 343/700 MS, 795, 816, 343/822, 820, 821, 829, 852, 859; 333/26, 246

[56] References Cited

U.S. PATENT DOCUMENTS

| | | | |
|---|---|---|---|
| 3,623,112 | 11/1971 | Rupp et al. | 343/821 |
| 3,678,418 | 7/1972 | Woodward | 333/26 |
| 3,681,769 | 8/1972 | Perrotti et al. | 343/814 |
| 3,845,490 | 10/1974 | Manwarren et al. | 343/821 |
| 3,947,850 | 3/1976 | Kaloi | 343/795 |
| 4,084,162 | 4/1978 | Dubost et al. | 343/700 MS |
| 4,460,877 | 7/1984 | Sterns | 333/26 |
| 4,495,505 | 1/1985 | Shields | 343/821 |
| 4,513,292 | 4/1985 | Bowman | 343/795 |
| 4,525,720 | 6/1985 | Corzine et al. | 343/895 |

FOREIGN PATENT DOCUMENTS

| | | | |
|---|---|---|---|
| 55-150 | 5/1979 | Japan | 333/26 |
| 54-102942 | 8/1979 | Japan | 343/700 MS |

*Primary Examiner*—William L. Sikes
*Assistant Examiner*—Michael C. Wimer
*Attorney, Agent, or Firm*—Mark P. Kahler; Joseph T. Downey; Anthony J. Sarli

[57] ABSTRACT

An balun-antenna arrangement is provided which is capable of being fabricated on a printed circuit board by automated equipment. The balun-antenna includes a microstrip transmission line which is coupled to one end of a split microstrip transmission line having opposed ends. An antenna which is symmetric about its feed-point is coupled to the remaining end of the split microstrip transmission line.

3 Claims, 2 Drawing Sheets

—PRIOR ART—

100

100

MICROSTRIP BALUN-ANTENNA APPARATUS

BACKGROUND OF THE INVENTION

This invention relates to baluns for matching an unbalanced port to a balanced port. More particularly, the invention relates to a microstrip balun and antenna arrangement.

In paging, portable and other radio communications applications, the antennas which are used in such systems often are fabricated by at least partially automated processes. However, the manufactured antenna product must often still be adjusted or "trimmed" to the desired operating frequency manually. Such manual trimming and the attendant manual testing of the antenna is time consuming and adds significant expense to the resultant antenna product.

For example, prior antennas such as the half wave sleeve dipole antenna 10 of FIG. 1 are mechanically relatively complex and require manual antenna adjustment and testing to bring the antenna to the desired antenna operating frequency. The detailed structure of a typical sleeve dipole antenna is set forth below such that the complexity of manufacturing and tuning such an antenna is fully appreciated.

In such an antenna, a wire radiator 20, which exhibits a length equivalent to approximately one quarter wavelength in air, is fed by the inner conductor 25 of a coaxial transmission line 30. A dielectric insulator 32 separates inner conductor 25 from outer conductor 35. The outer conductor 35 of coaxial transmission line 30 is electrically coupled to feed a metallic sleeve 40 which is also approximately one quarter wavelength long in air. To improve the compactness of this antenna structure, metallic sleeve 40 is normally disposed about a portion of coaxial transmission line 30, with a uniform dielectric spacer 45 positioned to maintain the proper physical relationship between the coaxial line 30 and the metallic sleeve 40. Dielectric spacer 45 is generally cylindrical in shape and serves to establish an outer transmission line 47 wherein the outer conductor is metallic sleeve 40 an the inner conductor is the outer conductor 35 of coaxial transmission lien 30. This outer transmission line is approximately one quarter of a wavelength in the dielectric material of spacer 45. A connector 55 is coupled to coaxial line 30 to facilitate connection of the antenna to radio devices.

Element 20 is typically cut during manufacture to a length which brings the resultant manufactured antenna to a frequency slightly lower than the desired operating frequency of the antenna. Additional manual frequency testing and trimming is then required to tune the antenna of FIG. 1 to the desired operating frequency. As already discussed, such additional steps are very expensive due to their manual nature. It is clear that antennas which avoid these steps are very desirable. It is also clear that antennas which are mechanically less complex are very desirable.

One balun-antenna apparatus which addresses the above described deficiencies of prior devices is described and claimed in U.S. patent application Ser. No. 878,898, filing date June 26, 1986 entitled Microstrip Balun-Antenna Apparatus, and assigned to the assignee of the present invention.

BRIEF SUMMARY OF THE INVENTION

One object of the present invention is to provide a balun-antenna apparatus which is capable of being manufactured by automated processes.

Another object of the present invention is to provide a balun-antenna apparatus which need not be trimmed or otherwise adjusted after manufacture to tune it to the desired operating frequency.

Another object of the invention is to provide a balun-antenna apparatus which exhibits wide bandwidth.

In one embodiment of the invention, a balun apparatus is provided which includes a substrate of dielectric material having first and second major surfaces. A microstrip transmission line having an input and an output is situated on the substrate. A microstrip balancing section having an input and an output is situated on the substrate. The section includes two substantially parallel conductors situated on the first surface and mutually connected at opposite first and second ends, the first end being coupled to the transmission line output. The section further includes two substantially parallel conductors on the second surface, such conductors being mutually connected at a first end to the transmission line output. First and second output nodes are situated respectively at the second ends of the second surface parallel conductors. The second end of the first surface parallel conductors is connected to said first node of the second surface conductors.

The features of the invention believed to be novel are specifically set forth in the appended claims. However, the invention itself, both as to its structure and method of operation, may best be understood by referring to the following description and the accompanying drawings.

DETAILED DESCRIPTION OF THE INVENTION

Figure 1:
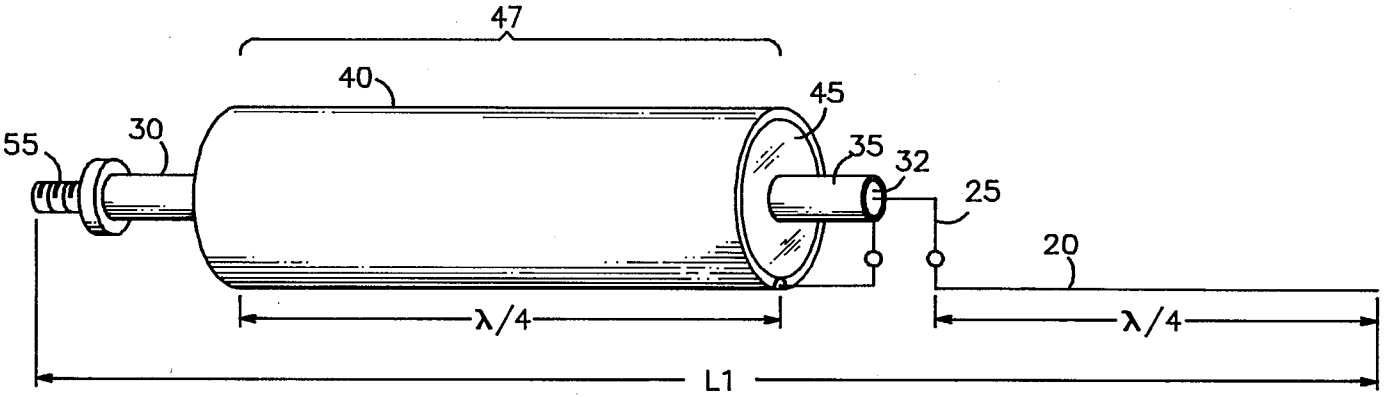
FIG. 1 is a representation of a conventional manually trimable coaxial dipole radio antenna.
Figure 2A:
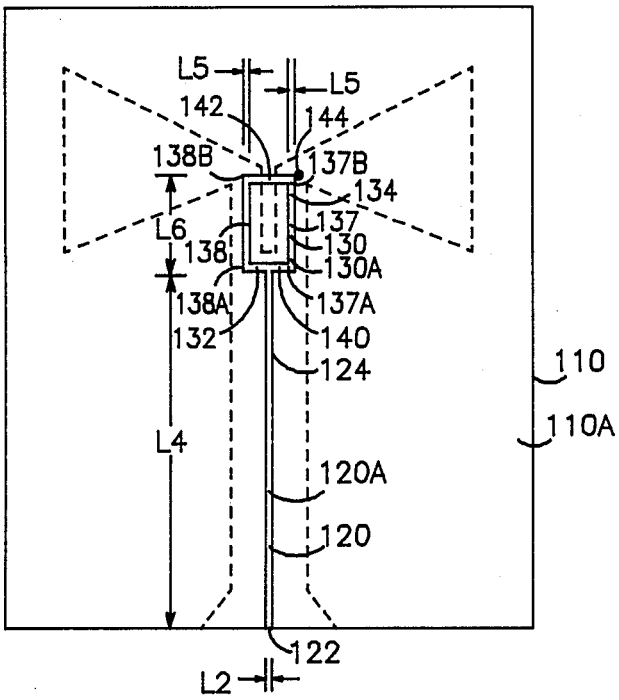
FIG. 2A is a representation of the microstrip side of the balun-antenna apparatus of the invention.
Figure 2B:
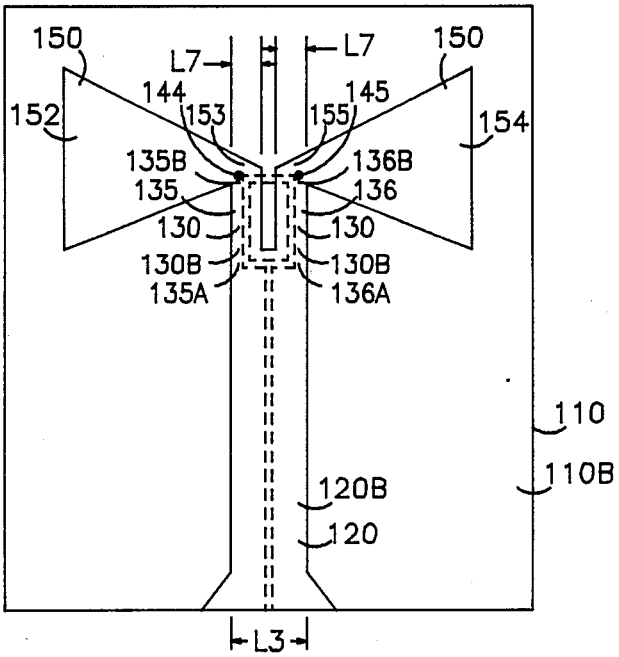
FIG. 2B is a representation of the ground side of the balun-antenna apparatus of the invention.

Turning now to FIG. 2A and 2B, one embodiment of the balun-antenna apparatus of the invention is shown as balun-antenna apparatus 100. FIG. 2A and 2B show the opposite sides of this embodiment of the invention respectively.

As seen in FIG. 2A, apparatus 100 includes a substrate 110 of dielectric material such as glass epoxy, Teflon (TM), or other electrically insulative material. From the subsequent discussion, it will become clear that the invention is especially well suited to being fabricated on a double-sided printed circuit board, in which case, the insulative layer of such board is used as substrate 110. Substrate 110 includes opposed major surfaces 110A and 110B shown in FIG. 2A and FIG. 2B., respectively.

A microstrip transmission line 120 is situated on surfaces 110A and 110B as shown in FIG. 2A and FIG. 2B. Transmission line 120 includes a microstrip conductor 120A situated on surface 110A and a microstrip ground strap 120B situated on surface 110B immediately below microstrip conductor 120A. Transmission line 120 includes an input 122 and an output 124 which are each unbalanced with respect to ground. Ground strap 120B is sufficiently wide that it acts as a ground plane for the microstrip conductor 120A situated above ground strap 120B.

For purposes of this example, a center frequency of 1.7 GHz is selected for balun-antenna apparatus 100, and the impedance of transmission line 120 is selected to be 50 ohms. Those skilled in the art will appreciate that balun-antenna apparatus 100 is conveniently scaled up or down in size to operate at other center frequencies and employ other characteristic impedances. However, in this example, wherein epoxy glass with a dielectric constant of 4.5 and a thickness of 0.79 mm is used as substrate 110, microstrip conductor 120A of FIG. 2A exhibits a width L2 equal to approximately 1.5 mm and microstrip ground strap 120B of FIG. 2B exhibits a width L3 equal to approximately 7 mm. Returning to FIG. 2A, microstrip transmission line 120 exhibits a length L4 which is conveniently selected to be as long as the particular application dictates providing the length L4 is not so long as to causes substantial signal loss in radio frequency signals supplied to transmission line 120. With the above dimensions, the impedance at the input 122 of transmission line 120 is 50 ohms (unbalanced) and the impedance at the output 124 of transmission line 120 is 50 ohms (unbalanced).

A balancing section 130 is coupled to transmission line output 124 as seen in FIGS. 2A and 2B. Balancing section 130 includes a split microstrip section 130A situated on substrate surface 110A and a split ground strap section 130B situated on substrate surface 110B immediately below split microstrip section 130A. Balancing section 130 includes an unbalanced input 132 which is coupled to transmission line output 124. Balancing section 130 further includes a balanced output 134.

As seen in FIG. 2B, split ground section 130B includes substantially parallel ground elements 135 and 136 including opposed ends 135A and 135B, and 136A and 136B, respectively. Ground element ends 135A and 136A are coupled to ground strap 120B of transmission line 120.

Referring now to FIG. 2A, split microstrip section 130A includes microstrip conductors 137 and 138 which are oriented substantially parallel with each other and which are situated above split ground elements 135 and 136, respectively. Microstrip conductors 137 and 138 include conductor ends 137A and 137B, and conductor ends 138A and 138B, respectively. Conductor ends 137A and 138A are coupled together by a conductor 140 which is coupled to transmission line output 124.

The width L5 of parallel microstrip conductors 137 and 138 is selected such that the impedance of each of conductors 137 and 138 is twice that of transmission line 120. Thus in this example, the width L5 of conductors 137 and 138 is approximately 0.33 mm such that the impedance of each of conductors 137 an 138 is 100 ohms. In this embodiment, the width of conductor 140 is selected to be equal to the width L5 of conductors 137 and 138. The length L6 of conductors 137 and 138 is somewhat less than a quarter of a wavelength (for example, 0.2 times a quarter wavelength in the dielectric) at the selected center frequency of balun-antenna apparatus 100. Thus, in this embodiment, where the center frequency of apparatus 100 is selected to be 1.7 GHz, L6 is approximately equal to 1.7 cm. The width L7 of the split ground elements 135 and 136 as seen in FIG. 2B is sufficiently wide to provide a groundplane for microstrip conductors 137 and 138, respectively thereabove. In the present example, L7 is approximately equal to 3 mm.

Referring again to FIG. 2A, conductor ends 138A and 138B are coupled together on substrate surface 110A by a conductor 142. In this example, the width of conductor 142 is selected to be equal to the width L5 of conductors 137 and 138. Since conductor 142 joins parallel conductor 137 and 138 (each of which it will be recalled exhibit an impedance of 100 ohms), conductor 142 exhibits an impedance of 50 ohms.

It is noted that in this embodiment, conductors 137, 138, 140 and 142 together form a rectangularly shaped conductive pattern on substrate surface 110A. Conductor 142 on surface 110A of FIG. 2A is coupled to one of ground element ends 135B and 136B of FIG. 2B via a through the board connection 144. For purposes of example, connection 144 is illustrated as coupling conductor 142 with ground element end 135B although an embodiment coupling conductor 142 with ground element end 136B is equally practical. As viewed in FIG. 2B, connection 144 represents an output node of balancing section 130. A node 145 at ground element end 136B represents the other output node of balancing section 130. Together, output nodes 144 and 145 form the balanced output of balancing section 130.

Referring again to FIG. 2B, a balanced, symmetric antenna 150 is coupled to ground element end 135B at node 144 and to ground element 136B at node 145. For example, a dipole antenna such as the dual delta shaped dipole antenna illustrated in FIG. 2B is employed as balanced, symmetric antenna 150. In this example, dipole antenna 150 includes a delta shaped element 152 which is coupled at its apex 153 to output node 144. In this manner, radio frequency energy which is supplied to transmission line 120 is coupled to element 152 via balancing section 130. A second delta shaped element 154 is coupled at its apex 155 to the remaining output node 145. It is noted that other balanced, symmetric antennas would operate satisfactorily as antenna 150. For example, a symmetric loop antenna may be employed as antenna 150. One end of such loop is coupled to output node 144, while the other end of the loop is coupled to remaining output node 145. In the examples discussed above, output nodes 144 and 145 are considered to be the balanced feedpoint of antenna 150.

The following is a brief summary of the operation of the present balun-antenna apparatus 100. For purposes of discussion, the side of the substrate on which surface 110A is located will be referred to as the microstrip side and the side of the substrate on which surface 110B is located will be referred to as the ground side. When balun-antenna apparatus 100 is used for transmitting, a radio frequency signal having a frequency of 1.7 GHz in this particular example is provided to input 122. The signal travels along the 50 ohm unbalanced transmission line 120 until it reaches transmission line output 124 at which the signal splits along the two 100 ohm paths formed by microstrip conductors 137 and 138 situated over ground elements 135 and 136, respectively, of balancing section 130. This splitting action provided by balancing section 130 results in a conversion from an unbalanced line to a balanced line. Split ground elements 135 and 136 perform the dual purposes of providing a ground plane and balancing, that is, transforming from an unbalanced to a balanced line. Split microstrip conductor 137 and 138 also contribute to this balancing action. Through-hole conection 144 and node 145 together with microstrip conductor 142 across the gap formed between split ground elements 135 and 136 form the required asymmetry between the split ground elements 135 and 136 to couple signals from the unbalanced microstrip side (110A) to the balanced antenna 150 on the ground side (110B) to permit the signal to be radiated by antenna 150. Connection node 144 together with node 145 act as the feedpoint for antenna 150.

The antenna of the invention is capable of being fabricated by photolithographic masking and etching techniques with considerable cost savings over conventional antennas which are not so suited. In this case, a double sided printed circuit board is used, the board itself being employed as substrate 110. The metallization on one side of the board is employed to fabricate the conductor pattern on substrate surface 110A of FIG. 2A. The metallization on the remaining side of the printed circuit board is employed to fabricate the conductor pattern on substrate surface 110B of FIG. 2B. This fabrication can be accomplished in an automated manner. The above discussed electrical connection through the board at connection (node) 144 is accomplished by automated drilling and riveting, or drilling and soldering, for example. The resultant antenna requires no trimming to tune it to the desired operating frequency because of the inherent wide bandwidth character of the balun and of the antenna elements.

The foregoing describes an balun-antenna apparatus which is capable of being fabricated by automated processes and which need not be adjusted or trimmed to tune it to the desired operating frequency. The antenna exhibits a very wide bandwidth of approximately 400 MHz for the 1.7 GHz embodiment described above. Further, the antenna of the invention is capable of being fabricated with minimal cost.

While only certain preferred features of the invention have been shown by way of illustration, many modifications and changes will occur to those skilled in the art. It is, therefore, to be understood that the present claims are intended to cover all such modifications and changes which fall within the true spirit of the invention.

We claim:

1. A balun apparatus having an unbalanced port and a balanced port comprising:

a single substrate of dielectric material having first and second major surfaces;

a microstrip transmission line situated on said substrate and having an input and an output;

a microstrip balancing section situated on said substrate and having an input and an output, said section including two substantially parallel conductors situated on said first surface and mutually connected at opposite first and second ends, said first end being coupled to said transmission line output and being defined as the unbalanced port of said balun apparatus, said section further including two substantially parallel conductors on said second surface, each of said second surface parallel conductors including third and fourth opposed ends, said second surface parallel conductors being mutually connected at said third ends to said transmission line output;

said second end of said first surface parallel conductors being directly connected via a feedthrough through said substrate to one of the fourth ends of said second surface parallel conductors, the fourth ends of said second surface parallel conductors being defined as the balanced port of said balun apparatus.

2. The balun arrangement of claim 1 including a balanced, symmetric antenna coupled to the output of said balancing section

3. The balun arrangement of claim 1 wherein said two first surface parallel conductors exhibit a length approximately equal to one quarter of a wavelength at the center frequency selected for said balun arrangement.

* * * * *